US007231900B1

(12) United States Patent
Hanshaw

(10) Patent No.: US 7,231,900 B1
(45) Date of Patent: Jun. 19, 2007

(54) SMALL ENGINE SHUT OFF SYSTEM

(76) Inventor: Michael S. Hanshaw, 109 Heather La., Springville, IA (US) 52336

( * ) Notice: Subject to any disclaimer, the term of this patent is extended or adjusted under 35 U.S.C. 154(b) by 0 days.

(21) Appl. No.: 11/317,088

(22) Filed: Dec. 24, 2005

Related U.S. Application Data

(63) Continuation-in-part of application No. 11/112,353, filed on Apr. 22, 2005, now abandoned.

(51) Int. Cl.
*F02B 11/08* (2006.01)
*F02D 17/00* (2006.01)

(52) U.S. Cl. ..... 123/198 D; 123/198 DB; 123/198 DC

(58) Field of Classification Search ..... 123/198 D, 123/198 DB, 198 DC
See application file for complete search history.

(56) References Cited

U.S. PATENT DOCUMENTS 6,986,340 B2 * 1/2006 Gracyalny et al. .... 123/198 DB

* cited by examiner

*Primary Examiner*—Noah P. Kamen
(74) *Attorney, Agent, or Firm*—Allan L. Harms; Wenzel & Harms, P.C.

(57) ABSTRACT

A normally closed ignition grounding switch mounted on the engine operates in concert with the fuel valve such that in order to "kill" the engine, the fuel valve must be moved from its open position. In one embodiment, a normally closed push button switch is mounted on the engine shroud in a position such that it is aligned with the sliding fuel valve lever so that the switch is released only when the fuel valve is moved toward its closed position. In an alternative embodiment, a normally open push button switch is mounted to the engine shroud aligned with the lever of the fuel valve such that closing the fuel valve depresses the push button switch.

12 Claims, 4 Drawing Sheets

SMALL ENGINE SHUT OFF SYSTEM

CROSS REFERENCE

This application is a continuation-in-part of patent application entitled "Small Engine Shut Off System", Ser. No. 11/112,353 filed Apr. 22, 2005, which is hereby incorporated in its entirety, now abandoned.

BACKGROUND OF THE INVENTION

This invention pertains to small gasoline engines and particularly to apparatus to force closure of the fuel supply valve to cause the engine to stop.

In the typical small gasoline engine, a manually activated switch is provided on the engine body which grounds the magneto of the engine when the user wishes to stop the engine from running. The engine is also equipped with a manually operable valve which may be activated to close the fuel line leading from the fuel reservoir to the engine fuel intake. When a small internal combustion engine is to be moved, it is especially advisable to close the fuel valve to prevent gasoline from draining into the engine as the engine is jostled and moved about, leading to overload of the intake valve of the carburetor and permitting gasoline to enter the combustion chamber. Gasoline in the combustion chamber when the engine is not running can cause delubrication of parts of the engine, namely the piston rings and cylinder wall. Manuals for small engines often carry instructions for the user to close the fuel supply valve when the engine is not running especially if it is to be moved, but many users pay little heed to these instructions, instead merely killing the engine and proceeding to move the equipment. As a result, lawn mowers, pressure washers, cement finishing equipment, and many other transportable devices powered by gasoline engines are transported from worksite to worksite with their fuel supply valves open, allowing gasoline to enter the engine eventually causing premature failure of the engine components. The loss of engines due to premature failure is a common and expensive problem which could be avoided with proper precautions or a system which would require closure of the fuel supply valve when the engine is stopped.

BRIEF SUMMARY OF THE INVENTION

The present invention provides a solution to the problem of a user's failure to close the fuel supply valve of a small internal combustion engine when the engine is not running. An ignition grounding switch may be mounted on the engine which is operable in concert with the fuel valve such that in order to "kill" the engine, the fuel valve must be closed. In one embodiment, a push button normally closed switch may be mounted on the engine cover in a position such that it is aligned with the sliding fuel valve lever and will be depressed when the fuel valve is moved to its open position. Alternatively, an ignition grounding switch may be combined with the fuel valve lever to accomplish stopping the engine only when the fuel valve is fully closed.

It is accordingly an object of the invention to provide a system to prevent premature deterioration of the engine piston and cylinder by preventing fuel from entering the combustion chamber when the engine is not running.

It is also an object to provide a system which forces the closure of the fuel supply valve when the engine is desired to be stopped from running.

It is further an object to provide a simple and inexpensive modification for an internal combustion engine to cause closure of the fuel supply valve in order to terminate the engine's operation.

These and other objects of the invention will become apparent from examination of the description and claims which follow.

DETAILED DESCRIPTION OF THE INVENTION

Figure 1:
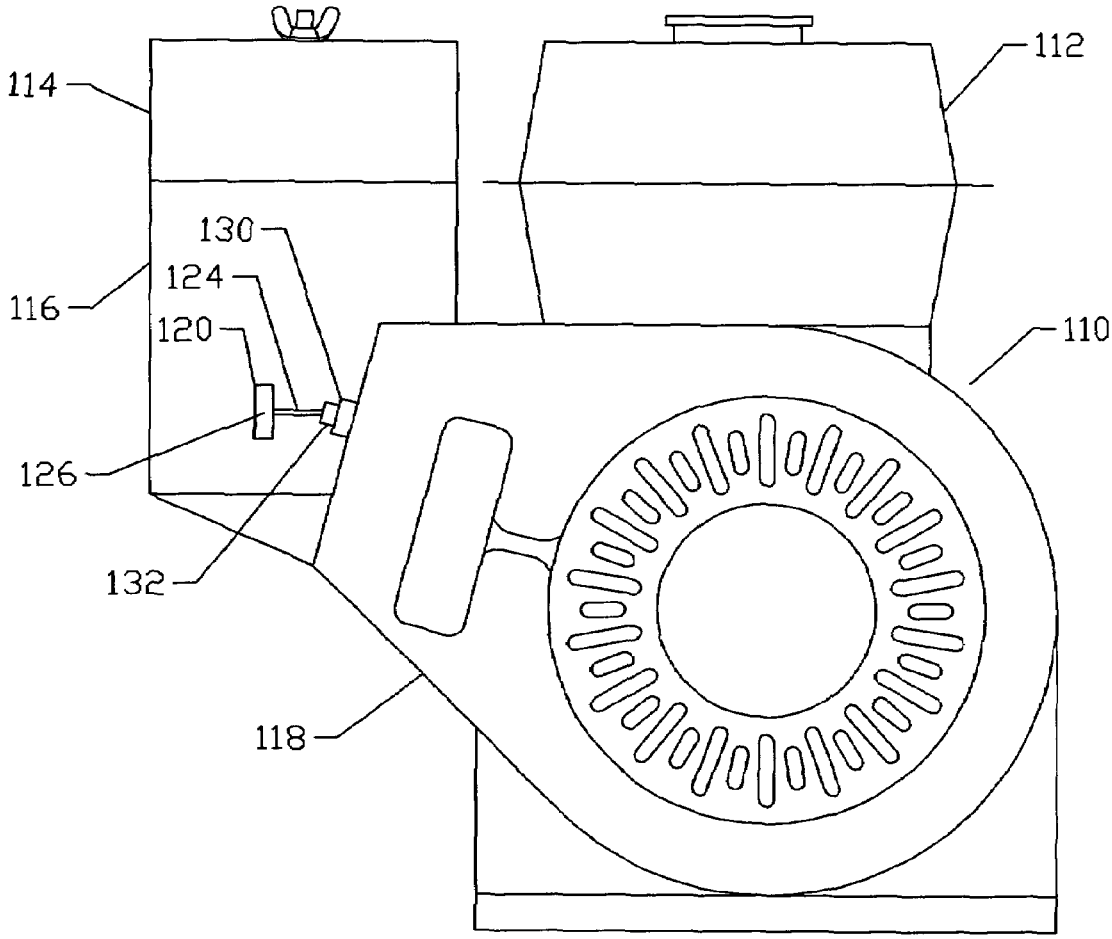
FIG. 1 is a front elevation of an internal combustion engine equipped with the preferred embodiment of the invention.

Referring to FIG. 1, a typical horizontal drive shaft internal combustion engine 110 is illustrated which has been modified with the preferred embodiment of the invention. Engine 110 comprises a fuel reservoir 112 which is communicative through a fuel supply valve by suitable ducts to the carburetor of the engine. Engine 110 also includes an air cleaner housing 114 atop carburetor housing 116. The fuel supply valve of engine 110 is manually operable by slide lever 120 which is shown in the closed position in FIG. 1. In the open position of the fuel supply valve with slide lever 120 moved to the right most position, fuel from fuel reservoir 112 may pass as needed to the carburetor within carburetor housing 116 where it is metered for consumption by engine 110.

The flywheel of engine 110 is covered by shroud 118 on which may be mounted a normally closed switch 130 which when closed will couple the magneto output of the engine 110 to ground to prevent firing of the spark plug. Switch 130 is preferably a normally closed push button switch, that is, when not depressed, switch 130 is closed. Switch 130 could be some other normally closed, biased switch which returns to closed condition when not affected by exterior forces. In the preferred embodiment, the position of the switch 130 is selected such that it is in alignment with the locus of travel of slide lever 120 along slot 124. Because switch 130 is operable by depressing push button 132, when fuel valve slide lever 120 is moved to the open position by moving it in a right hand direction as viewed in FIG. 1, the handle 126 of slide lever 120 will touchingly engage push button 132 causing it to depress and to open the switch 130 thereby removing a ground connection to the spark plug.

Because the movement to open position of fuel valve slide lever 120 depresses push button 132 to open the connection between the magneto and ground, engine 110 is enabled to run. In order to cease operation of engine 11, a user must move slide lever 120 along slot 124 to close the fuel valve in order to allow push button 132 to extend, thereby closing switch 130 to its normally closed condition, whereupon the magneto becomes grounded and the engine cannot run. Therefore, in order to stop the engine 110, the user must close the fuel valve.

Though the preferred embodiment of the invention has been illustrated in FIG. 1, it should be understood that many variations of the invention may be constructed in which closure of the fuel supply valve of the engine is required to effect closure of a grounding circuit to the spark plug causing it to be disabled and the engine 110 to stop.

Figure 2:
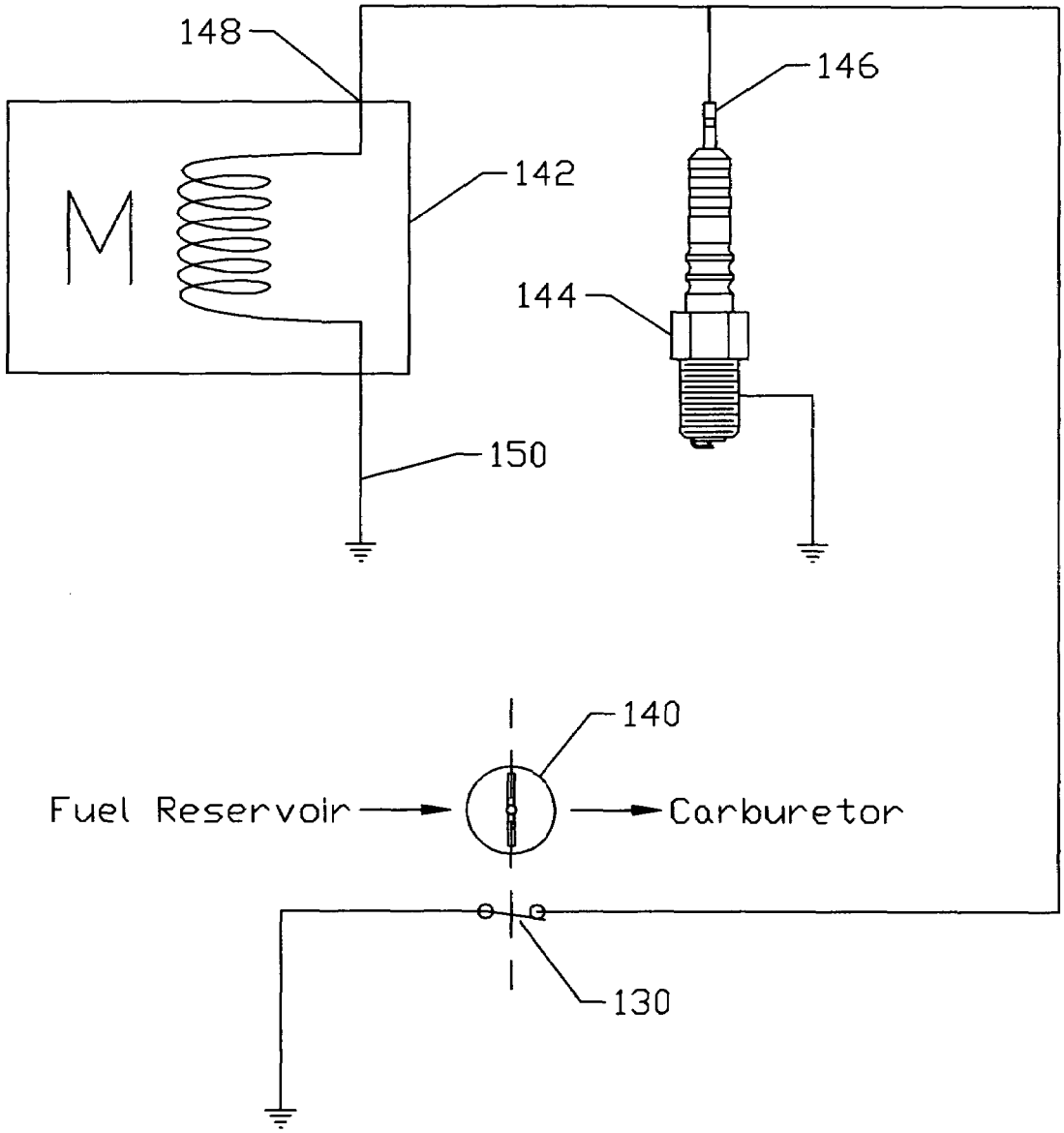
FIG. 2 is schematic representation of the preferred embodiment of the invention.

FIG. 2 illustrates schematically the interaction of the fuel supply valve 140 and the grounding switch 130. As seen in FIG. 2, a voltage inducing coil such as magneto 142 is electrically coupled to system ground 150 on one side and it is coupled at output terminal 148 to the active terminal 146 of spark plug 144 on the other side such that voltage generated in magneto 142 will energize spark plug 144. The active terminal 146 of spark plug 144 is coupled to switch 130 which is preferably a normally closed push button switch or some other switch which is biased to rest in an closed position causing active terminal 146 to be grounded until the switch 130 is caused to open. Switch 130 is mechanically coupled to fuel valve 140 such that until fuel valve 140 is closed, switch 130 will be prevented from closing. Therefore, in order for engine 110 to be stopped, fuel valve 140 must be moved to closed position. Conversely, in order for engine 110 to be enabled to run, fuel valve 140 must be moved from its open position to permit fuel to reach the combustion chamber and switch 130 must be opened. In the preferred embodiment illustrated in FIG. 1, touching contact between the valve slide lever 120 and push button 132 accomplishes the opening of the ground connection to the magneto and the spark plug when the fuel valve 140 is opened.

With this arrangement, the user of engine 110 will be required to close the fuel supply valve 140 when cessation of engine operation is desired.

Though the preferred embodiment of the invention has been illustrated in FIGS. 1 and 2, it should be understood that many variations of the invention may be constructed in which closure of the fuel supply valve of the engine must be made to cause closure, of a grounding circuit to the spark plug causing it to disable the engine 110. For instance, the normally closed grounding switch 130 could be integrated with the fuel valve 140 in order that the engine 110 will not stop until the fuel valve 140 is closed. As another alternative, the normally closed grounding switch 130 could be located other than on the shroud 118 of engine 110 so long as any stoppage of engine operation cannot be effectuated unless the fuel valve 140 is moved to its closed position.

Modification of an engine 110 in factory equipped condition may be made using a kit comprising a normally closed temporarily open push button switch with conductors for connection to ground 150 and to the magneto 142. A hole may be made in the shroud 118 to mount the switch such that the push button of the switch will be pushed by the fuel valve lever when it is moved to its open position. Any existing grounding switch on the engine would be disconnected or removed.

Figure 3:
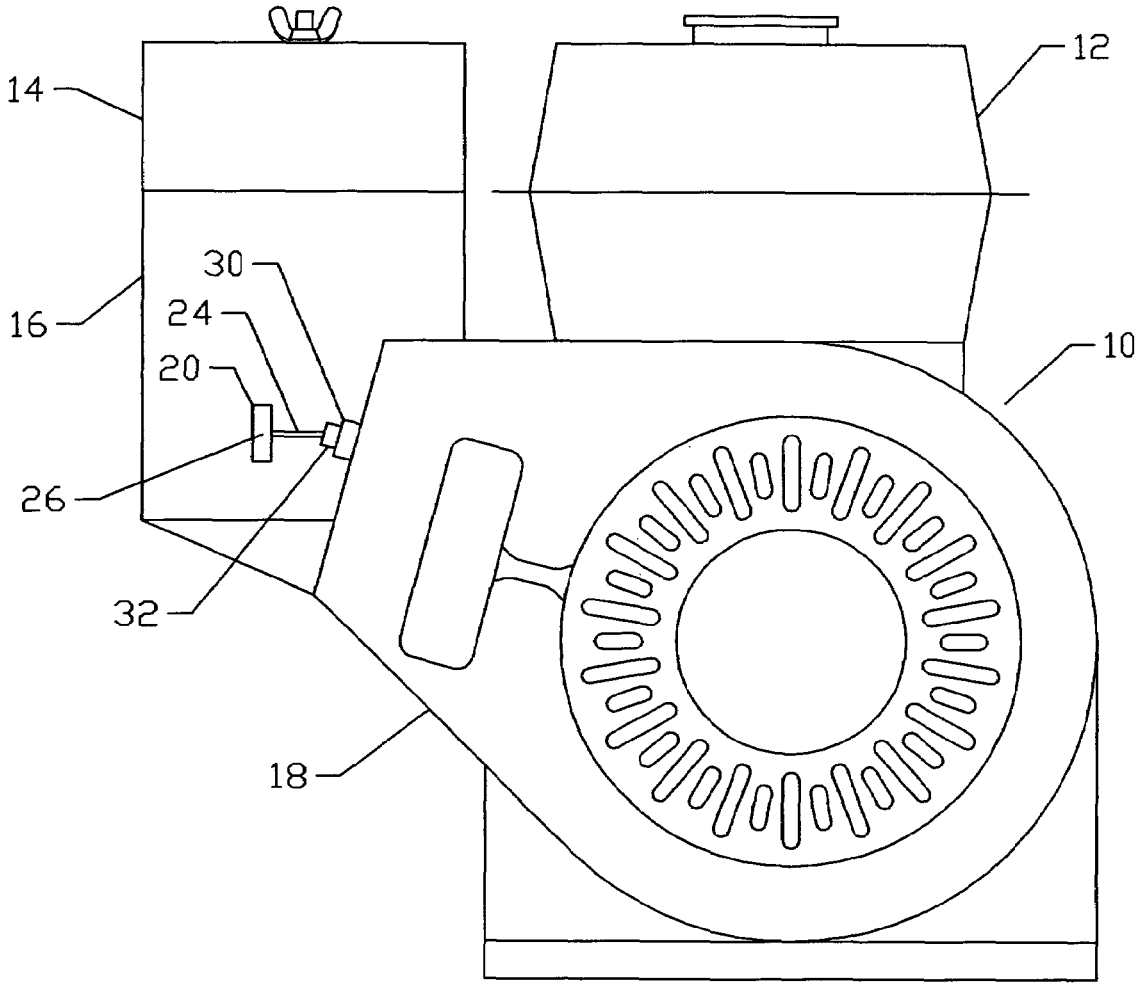
FIG. 3 is front elevation of an internal combustion engine equipped with an alternative embodiment of the invention.
Figure 4:
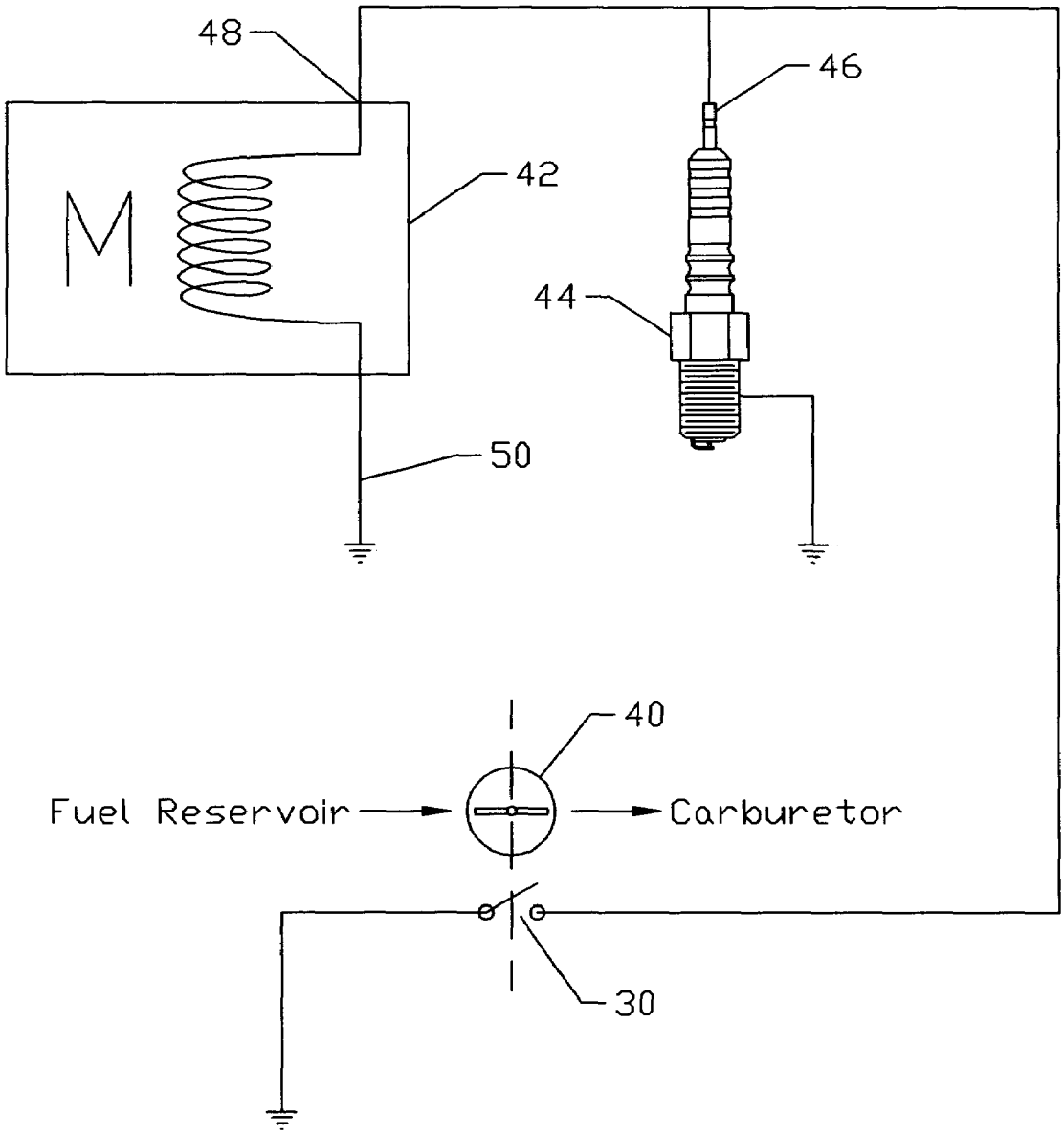
FIG. 4 is schematic representation of the alternative embodiment of the invention.

Referring now to FIGS. 3 and 4, an alternative engine grounding system is disclosed. Referring specifically to FIG. 3, a typical horizontal drive shaft internal combustion engine 10 is illustrated which has been modified with the alternative embodiment of the invention. Engine 10 comprises a fuel reservoir 12 which is communicative through a fuel supply valve by suitable ducts to the carburetor of the engine. Engine 10 also includes an air cleaner housing 14 atop carburetor housing 16. The fuel supply valve of engine 10 is manually operable by slide lever 20 which is shown in the open position in FIG. 3. In the alternative embodiment, the slide lever 20 operates conversely to slide lever 120 of the preferred embodiment. In the open position of the fuel supply valve with slide lever 20 moved to the leftmost position, fuel from fuel reservoir 12 may pass as needed to the carburetor within carburetor housing 16 where it is metered for consumption by engine 10.

The flywheel of engine 10 is covered by shroud 18 on which may be mounted a normally open switch 30 which when closed will couple the magneto output of the engine 10 to ground to prevent firing of the spark plug. Switch 30 is a normally open push button switch. The position of the switch 30 is selected such that it is in alignment with the locus of travel of slide lever 20 along slot 24. Because switch 30 is operable by depressing push button 32, when fuel valve slide lever 20 is moved to the closed position by moving it in a right hand direction as viewed in FIG. 3, the handle 26 of slide lever 20 will touchingly engage push button 32 causing it to depress and to close the switch 30 thereby grounding the spark plug.

FIG. 4 illustrates the alternative embodiment schematically showing the interaction of the fuel supply valve 40 and the grounding switch 30. As seen in FIG. 4, magneto 42 is electrically coupled to system ground 50 on one side and it is coupled at output terminal 48 to the active terminal 46 of spark plug 44 on the other side such that voltage generated in magneto 42 will energize spark plug 44. The active terminal 46 of spark plug 44 is coupled to switch 30 which may be a normally open push button switch or some other switch which rests in an open position preventing active terminal 46 from being grounded until the switch is caused to close. Switch 30 is mechanically coupled to fuel valve 40 such that the adjustment of fuel valve 40 to a closed position will cause switch 30 to close, thereby grounding the magneto output terminal 48 and spark plug 44. In the alternative embodiment illustrated in FIGS. 3 and 4, touching contact between the valve slide lever 20 and push button 32 accomplishes the grounding of the spark plug when the fuel valve 40 is closed.

The foregoing description of the invention has been presented for purposes of illustration and description and is not intended to be exhaustive or to limit the invention to the precise form disclosed. Modifications and variations of the embodiment are possible in light of the above disclosure or such may be acquired through practice of the invention. The embodiments illustrated were chosen in order to explain the principles of the invention and its practical application to enable one skilled in the art to utilize the invention in various embodiments and with various modifications as are suited to the particular use contemplated. It is intended that the scope of the invention be defined by the claims appended hereto, and by their equivalents.

Having described the invention I claim:

1. A system to effect cessation of operation of an internal combustion engine having a magneto comprising a normally closed switch coupling the magneto to ground when the switch is closed, the switch biased to a closed condition, a fuel supply shut off valve operable from a closed position to an open position, the fuel supply shut off valve urging the switch to open when the fuel supply shut off valve is in its open position.

2. The system of claim 1 wherein the switch is mechanically coupled to the fuel supply shut off valve.

3. The system of claim 1 wherein the fuel supply shut off valve includes a lever, the lever touchingly engaging the switch when the fuel supply shut off valve is in the open position, the switch opened only when engaged by the lever.

4. The system of claim 1 wherein the switch is a push button switch.

5. The system of claim 1 wherein the switch is mounted to a shroud of the engine.

6. The system of claim 1 wherein the switch is a normally closed push button switch mounted to a shroud of the engine, the fuel supply shut off valve includes a slide lever, the slide lever touchingly engaging the switch when the fuel supply shut off valve is moved to an open position thereof, the switch in an open condition when the fuel valve is in the open position thereof.

7. The system of claim 6 wherein the slide lever is manually operable.

8. An internal combustion engine having a spark plug energized by a magneto, and having a fuel shut off valve, the invention comprising a switch coupled to ground and to an output terminal of the magneto, the fuel shut off valve comprising a lever, the switch mounted to a shroud of the engine, the lever touchingly contacting the switch when the fuel shut off valve is moved to a closed position, the switch closing when it is touched by the lever.

9. An internal combustion engine having a spark plug energized by a magneto, and having a fuel shut off valve, the invention comprising a normally closed switch coupled to ground and to an output terminal of the magneto, the switch coupled to the fuel shut off valve, the switch in an open condition only when the fuel shut off valve is in an open position, the switch is mounted to a shroud of the engine.

10. An internal combustion engine having a spark plug energized by a magneto, and having a fuel shut off valve, the invention comprising a normally closed switch coupled to ground and to an output terminal of the magneto, the switch coupled to the fuel shut off valve, the switch in an open condition only when the fuel shut off valve is in an open position, the fuel supply shut off valve including a lever, the lever touchingly engaging the switch when the fuel supply shut off valve is in the open position, the switch opened when engaged by the lever.

11. The internal combustion engine of claim 10 wherein the switch is a normally closed push button switch.

12. The internal combustion engine of claim 10 wherein the switch is mounted to a shroud of the engine.

* * * * *